United States Patent [19]

Jeter

[11] 4,080,094

[45] Mar. 21, 1978

[54] DOWNHOLE MOTOR ROTOR SUPPORTS

[75] Inventor: John Doise Jeter, Iowa Park, Tex.

[73] Assignee: Eastman-Whipstock, Inc., Houston, Tex.

[21] Appl. No.: 714,595

[22] Filed: Aug. 16, 1976

[51] Int. Cl.[2] ..... F01D 3/00

[52] U.S. Cl. ..... 415/107; 415/1; 415/113; 415/502

[58] Field of Search ..... 415/1, 105, 106, 107, 415/110–113, 501, 502; 417/7, 360

[56] References Cited

U.S. PATENT DOCUMENTS

| | | | |
|---|---|---|---|
| 1,277,381 | 9/1918 | Chapman | 415/112 |
| 1,285,644 | 11/1918 | Doble et al. | 415/112 |
| 1,320,736 | 11/1919 | Chapman | 415/111 |
| 1,701,468 | 2/1929 | Arutunoff | 415/111 |
| 1,872,538 | 8/1932 | Weis | 415/111 |
| 2,301,340 | 11/1942 | Spengler | 415/111 |
| 2,592,519 | 4/1952 | Postlewaite | 415/107 |
| 2,991,837 | 7/1961 | Postlewaite | 415/111 |
| 3,054,595 | 9/1962 | Kaufmann | 415/107 |
| 3,058,510 | 10/1962 | Tiraspolsky et al. | 415/107 |
| 3,989,409 | 11/1976 | Ioannesian | 415/107 |

*Primary Examiner*—C. J. Husar
*Attorney, Agent, or Firm*—John D. Jeter

[57] ABSTRACT

Method and apparatus to lift the rotor of an earth borehole downhole drilling motor with a resilient force that exceeds the rotor weight so that starting of the motor is more certain due to reduced drag on primary thrust bearings. Additionally the apparatus may be used to reduce imbalanced axial loads on rotor primary thrust bearings.

8 Claims, 1 Drawing Figure

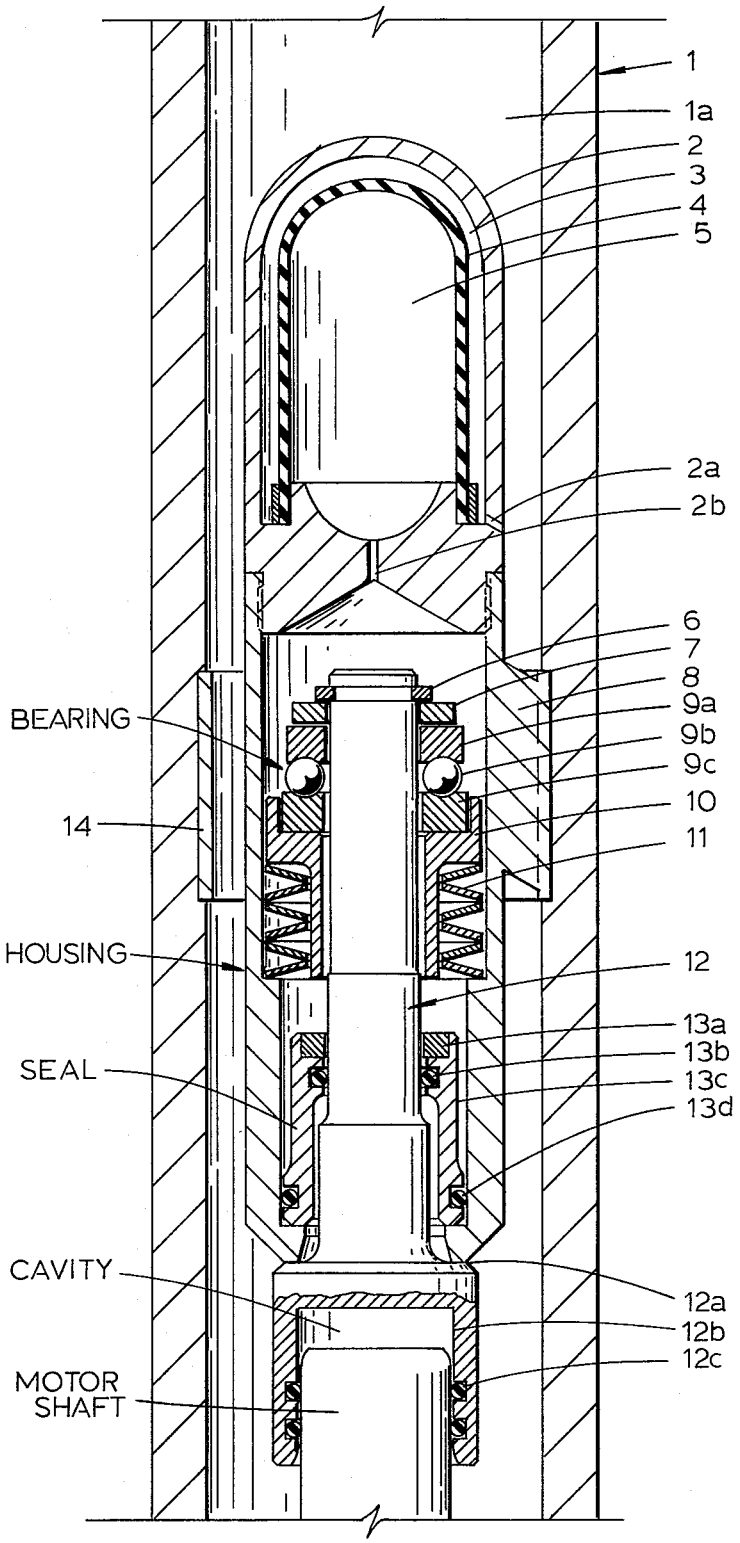
1
1a
2
3
4
5
2a
2b
6
7
8
9a
9b
9c
10
11
12
13a
13b
13c
13d
12a
12b
12c
BEARING
14
HOUSING
SEAL
CAVITY
MOTOR
SHAFT

DOWNHOLE MOTOR ROTOR SUPPORTS

The device of this invention relates to the bearings in general for downhole earth borehole drilling motors and more particularly to motors having sliding thrust bearings.

Downhole drilling motors in common use have sliding thrust bearings and these bearings are commonly made of rubber sliding on steel. The bearings, although free running at the earth surface, sometimes stick and will not allow the motor rotor to start running once the equipment arrives downhole. There may be many contributing causes for this phenomenon, but some specialists believe that the lubricant, normally drilling fluid, is squeezed out of the sliding contact area as the motor makes the trip downhole. Drilling specialists often run a stalled motor shaft against the borehole bottom — with bit attached — to lift the rotor off the bearing seats. This is a rather effective way of getting a stalled motor started. It is common knowledge that this brief lifting of the rotor allows drilling fluid to flood the thrust bearing sliding surfaces, reducing friction. Whatever the total reason for the benefits derived, the lifting of the rotor is established practice and usually works.

It is recognized that running a drill bit, particularly a diamond bit, into a borehole bottom before junk and granules have been flushed off bottom can be destructive to the bit. Likewise, if the bit has not drilled a seat into the bottom, concentrated loads can damage the bit as it hits bottom to place an upward force on the rotor.

It is desirable to lift the rotor slightly to introduce fluid between the thrust bearing sliding elements before starting the flow of drilling fluid which produces downthrust on rotating parts. It is desirable to lift the rotor without depending on bit load. It is therefore an object of this invention to provide method and apparatus for lifting a downhole motor rotor off the thrust bearing seats without depending on drilling fluid flow or bit load.

It is another object of this invention to provide method and apparatus to lift the rotor with a resilient force such that when downward flow of drilling fluid is started the downthrust due to the flow will urge the rotor downward to cause effective contact between the thrust bearing elements.

It is yet another object of this invention to provide apparatus to utilize the hydrostatic head due to depth of a fluid filled earth borehole in which the apparatus is used to provide the activating force for the rotor lifting resilient force system.

It is another object of this invention to provide apparatus with anti friction bearings to lift the rotor so that the rotor can freely rotate with minimum drag at start up.

It is yet another object of this invention to provide hydrostatic pressure powered actuator means to load the resilient force means so that the elements of the apparatus can be assembled in the unloaded state at the earth surface and be subsequently loaded as the apparatus is lowered into the borehole.

It is another object of this invention to combine the force actuating elements and the elements required to attach the device of this invention to the motor rotor such that hydrostatic pressure resulting from lowering the apparatus into a fluid filled hole serves both the lifting and connecting functions.

These and other objects, advantages, and features of this invention will be apparent to those skilled in the art from a consideration of this specification, including the attached drawings and appended claims.

BRIEF DESCRIPTION OF DRAWINGS

FIG. 1 is a sectional view through the device of this invention.

DETAILED DESCRIPTION OF DRAWINGS

In FIG. 1, part 1 is an extension of a drill string with upper connection means (not shown) to connect to the upwardly continuing drill string and means at the lower end (not shown) to connect to the downwardly continuing drill string. It is to be realized that part 1 may be a separate member attached to the body of the motor it serves or it may be a part of that body. Since the drill string comprises all members providing continuity from earth surface to the drill bit at the bottom, the term applied to part 1 is rather encompassing. Bore 1*a* provides the opening for flow of drilling fluid in drilling operations and space for mounting the apparatus of this invention. The housing is supported within the bore 1*a* by captured sleeve 14 and spiders 8. The details for capturing sleeve 14 are within the art and are omitted from the drawing for simplicity.

Shaft 12 is shown in the axial position of assembly. There is no load on springs 11. The cavity formed between the motor shaft and the bore 12*b* is not yet closed. Ambient hydrostatic pressure will close the cavity by process to be described later, when the apparatus is lowered into a fluid filled bore hole. Ambient pressure will enter dome 2 through opening 2*a* and exist in enclosure 3 to collapse bag 4 to transfer hydrostatic pressure to fluid filled enclosure 5. Pressure enters the housing through port 2*b* and acts on shaft 12.

Ambient pressure acts on all surfaces of shaft 12 and a resultant downward force is related to the cross sectional area of bore 12*b*. Ambient pressure acts on all exposed surfaces of the motor rotor. The resultant upward force is related to the cross sectional area of the motor shaft in bore 12*b*. Bore 12*b* is filled with a compressible fluid (probably air) at the time the motor shaft and shaft 12 become an assembly at the earth surface. In practice, part 1 will likely be a structure attached to the body of the motor such that, when so attached, the axial position of shaft 12 is as shown. When the cavity is collapsed, the downward movement of shaft 12 is enough to load springs 11. No troublesome connections betweeen shaft 12 and the motor shaft is then required. The thrust bearing is axially affixed to shaft 12 by lockring 6. Collar 7 transfers thrust, when the cavity is collapsed and shaft 12 moves down, to the thrust bearing upper race shown as 9*a*. Race 9*a* loads rolling elements 9*b* which in turn loads race 9*c*. Race 9*c* is supported by arbor 10 which rests on springs 11. These are shown to be stacked Belleville springs. Any resilient loading means such as coil springs, gas bags or piston supplied by any source of pressure can be substituted for spring 11 without departing from the spirit of the resilient force system. Springs 11 can rest on any convenient abutment within the housing. No key is shown in the telescoping parts of shaft 12 and the motor shaft as none should be needed. If needed, such keys are within the art.

The seal consists of carrier 13*c*, seal 13*b* in contact with shaft 12, seal 13*d* in contact with a surface of the housing, and bearing 13*a* to centralize seal 13*b* with respect to shaft 12. The seal can be positioned by any suitable axial constraint shown as an abutment in a bore of the housing. Carrier 13*c* may be pinned to prevent rotation. It is shown here free to rock as dictated by bearing 13*a*. The seal prevents drilling fluid from entering the bearing region of the housing enclosure.

Seals 12*c* fitted into grooves in bore 12*b* prevent drilling fluid from entering the cavity.

As the cavity is closed by ambient pressure and shaft 12 moves downward through seal 13*b* the volume of material within the housing is reduced. Compensation is required and this is accomplished by the collapse of resilient element 4, reducing the internal volume of the sealed enclosure.

The bearing, of course, may be situated for axial support by an abutment on the housing with the spring acting between the bearing and the thrust collar 7 on the shaft. Alternatively, the spring 11 may be of two elements, one above the bearing and one below so that the bearing is not directly exposed to shock loads imposed by either housing or shaft.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A method of separating sliding thrust bearing surfaces on downhole drilling motor rotors which experience downthrust on rotors due to the downward flow of drilling fluid in earth borehole operations to allow fluid to fill the space between bearing sliding surfaces comprising the steps of:

1. applying a resilient upward force on said rotor of an amount greater than the rotor weight and less than the combined rotor weight and hydraulic downthrust produced by a downward flow of fluid through the motor;
2. pumping fluid downward through the motor thereby overcoming said upwardly directed resilient force and moving said rotor downwardly to load said sliding bearings whereby fluid in the motor may flood exposed thrust bearing surfaces to ease starting of the motor.

2. The method of claim 1 with the additional step of lowering the motor into a fluid filled borehole and utilizing the resulting change in hydrostatic head to supply said resilient force.

3. Apparatus for temporarily lifting the rotor of an earth borehole bit driving downhole motor in which the rotor experiences downthrust due to downward flow of drilling fluid to separate the sliding surfaces of thrust bearings comprising:

1. a housing mounted within the bore of a tubular drill string member;
2. a shaft within said housing radially supported for rotation therein;
3. means to attach said shaft to the motor rotor;
4. a bearing situated for transmitting axial loads between said housing and said shaft while permitting relative rotation;
5. resilient force means to apply an upwardly directed resilient force greater than the rotor weight and less than the sum of rotor weight and downthrust between said housing and said shaft by way of said bearing.

4. The apparatus of claim 3 in which said resilient force is actuated by actuator means responsive to the hydrostatic head resulting from lowering the apparatus into a fluid filled earth borehole.

5. The apparatus of claim 3 in which said means to attach said shaft to said rotor is an actuator means responsive to the hydrostatic head resulting from the lowering of the apparatus into a fluid filled earth borehole.

6. The apparatus of claim 4 in which said actuator means is structurally coincident with said means to attach said shaft to said rotor both being responsive to hydrostatic head of a fluid filled borehole.

7. The apparatus of claim 3 in which said shaft is attached to said rotor by a telescoping pair of elements in sealing engagement such that when the telescoped pair is extended a cavity is formed therebetween, a compressible fluid filling said cavity, means to axially attach one of said pair to said shaft and means to attach the other of said pair to said rotor whereby ambient hydrostatic pressure in fluid filled boreholes will cause said telescoping pair to contract to reduce the size of said cavity thereby drawing said rotor and said shaft together for relative axial positioning and constraint.

8. The apparatus of claim 7 in which said resilient means is a spring and in which said actuation of said resilient means is accomplished by the spacing of said telescoping pair such that said rotor is lifted to the limit of its upward travel and said spring is compressed by the downward movement of said shaft such that the selected lifting force is applied to said rotor.

* * * * *